United States Patent [19]

Ottestad et al.

[11] Patent Number: 4,550,784

[45] Date of Patent: Nov. 5, 1985

[54] TOOL MOUNTING MEANS FOR A HYDRAULICALLY POWERED IMPACT HAMMER

[76] Inventors: Jack B. Ottestad, 1442 Muirlands Dr., La Jolla, Calif. 92037; Bernard W. Duehr, Jr., 4525 Twain Ave., Apt. 17, San Diego, Calif. 92120

[21] Appl. No.: 455,213

[22] Filed: Jan. 3, 1983

[51] Int. Cl.[4] ..... B25D 9/14

[52] U.S. Cl. ..... 173/114; 173/128; 173/139

[58] Field of Search ..... 173/15–17, 173/132, 134, 139, 162 R, 114, 90, 116, 128; 175/92; 279/3, 19.6, 19.7

[56] References Cited

U.S. PATENT DOCUMENTS 2,147,828 2/1939 Daniels ..... 173/90

4,111,269 9/1978 Ottestad ..... 173/134

FOREIGN PATENT DOCUMENTS 537836 5/1930 Fed. Rep. of Germany ..... 279/19.6

*Primary Examiner*—James M. Meister

*Assistant Examiner*—John L. Knoble

*Attorney, Agent, or Firm*—Donald D. Mon

[57] ABSTRACT

A hydraulically powered impact hammer utilizes hydraulic power to compress a gas charge to store energy. The energy is simply released to drive a hammer to strike a tool. A tool mount is slidably mounted to the frame that supports the hammer. The mount is cup-like and surrounds part of the frame. It carries a tool which is driven when the hammer strikes the mount.

5 Claims, 2 Drawing Figures

TOOL MOUNTING MEANS FOR A HYDRAULICALLY POWERED IMPACT HAMMER

FIELD OF THE INVENTION

This invention relates to hydraulically actuated hammers in which a gas charge is hydraulically compressed to store energy that is abruptly released to drive the hammer. A tool is driven by the hammer. In particular, the invention relates to a mount for holding the tool that is driven.

BACKGROUND OF THE INVENTION

Hydraulically-powered impact tools are well-known. A charge of energy is abruptly released to drive a hammer that strikes a tool. An excellent example of such a tool is shown in Ottestad's U.S. Pat. No. 4,111,269, issued Sept. 5, 1978, which is incorporated in its entirety by reference, as though fully set forth herein. It is especially incorporated for its showing of a means to drive a hammer (gas chamber 17, loading chamber 25, piston 35 and piston head 55 therein), and the hammer itself (piston head 55 and piston rod 56, therein called "driving member"). The hammer therein drives a tool 86.

The conventional means for mounting a tool is to place it inside a long bearing, limiting its upward movement by some kind of stop shoulder. The hammer impacts the tool to drive it into the work. In order to withstand bending loads that might be applied as the tool is driven into the work, the length of the tool in the bearing is usually two or three times the diameter of the tool. Thus if a four inch diameter tool is used, the bearing must be 8 to 12 inches long. This is disadvantageous, especially when the tool must be used in close quarters.

It is an object of this invention to provide tool mounting means which can be made more compact and shorter, which can resist substantial bending loads, which can seal the assembly against chips and dust, which can penetrate the work, and which can be retained by non-mechanical means.

BRIEF DESCRIPTION OF THE INVENTION

This invention is carried out with a hydraulically powered impact hammer of the type which utilizes a hydraulically compressed gas charge to store energy. The energy is abruptly released to drive the hammer. A frame supporting the hammer has a nose with an external axially-extending bearing. A tool mount is adapted to mount a tool. It is cup-shaped and has an internal bearing to slidingly fit on the external bearing. The mount is placed where it will be struck by the hammer.

The above and other features of this invention will be fully understood from the following detailed description and the accompanying drawings, in which:

DETAILED DESCRIPTION OF THE INVENTION

Figures 1, 2:
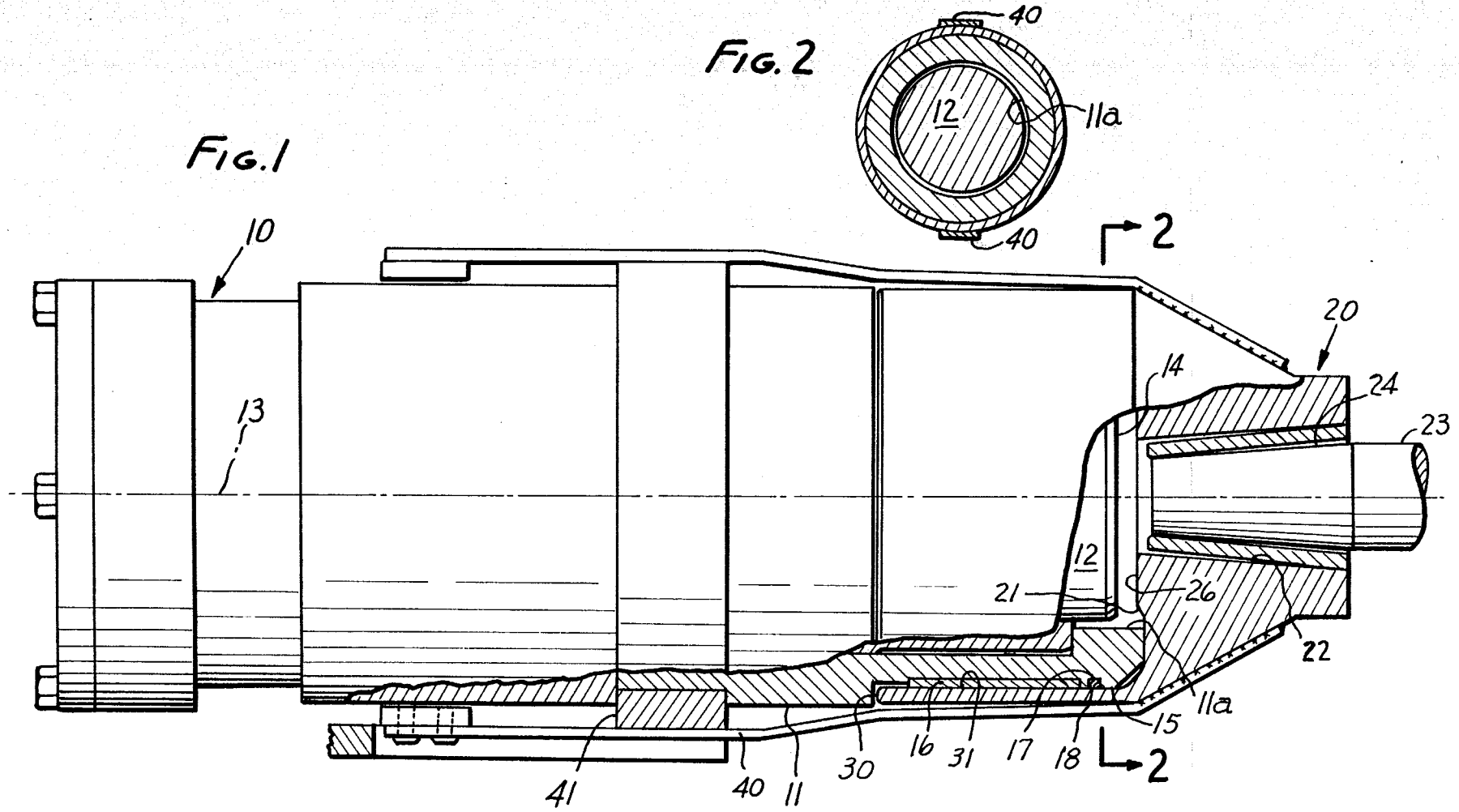
FIG. 1 is a side view, partly in cutaway cross-section showing the presently-preferred embodiment of the invention.
FIG. 2 is a cross-section taken at line 2—2 in FIG. 1.

FIG. 1 shows a conventional hydraulic-pneumatic drawing unit 10 of the type that is fully described in said Ottestad patent, to which reference may be had for full details. Because such details are not of importance to this invention, they are not described here.

The unit does include a frame 11 having an internal passage 11*a* in which a hammer 12 is driven along an axis 13. Face 14 of the hammer is its striking face, and exerts a striking blow when driven to the right in FIG. 1.

Frame 11 has a nose 15 with a fully peripheral external, axially-extending cylindrical bearing surface 16. A ring groove 17 is adjacent to the bearing and seats a sealing ring 18.

A tool mount 20 is generally cup-shaped. It has a central portion 21 with a tapered axial opening 22 whose conical wall enlarges as it extends away from the hammer. A tool 23 such as a drill or chipper has a conical shank 24 that fits in opening 22, thereby to be held to the mount. A raised portion 26 is formed in the bottom of the mount to be struck by the hammer. This will usually be preferred to making a direct blow on the tool, although with some arrangements the tool might be struck directly instead.

The mount has a peripheral flange 30 which has on its inside a peripheral cylindrical axially-extending bearing surface 31. Bearing surfaces 16 and 31 are relatively axially slidable. Surface 31 makes a fluid-sealing contact with sealing ring 18.

Retention means 40 are optional but useful. Such means may constitute arms welded to the mount which are releasably engageable with a shoulder 41 on the frame to prevent the mount from falling off when the unit is being carried around. Dimensions are selected so that the mount can move axially in its operating range without impediment by the retention means.

Because the diameters of the bearing surfaces are much larger than those of the conventional hammers, sufficient bearing area to resist bending forces can be provided in a shorter length. This is particularly advantageous where the tool is used with mining machines where space is limited.

Also, the mount can be shaped so it can enter the work. This further reduces the over-all length.

In addition, the bearing length overlaps some of the hammer length—they are not in-line. This still further shortens the necessary length.

The cup arrangement serves to exclude dust and chips.

The seal 18 enables a low pressure to be developed between the frame, the mount and the hammer. This low pressure causes a net force on the mount tending to restrain it from being driven off of the frame during operation of the hammer.

As a consequence, a more compact and effective system is provided.

This invention is not to be limited by the embodiment shown in the drawings and described in the description, which is given by way of example and not of limitation, but only in accordance with the scope of the appended claims.

We claim:

1. In combination with a hydraulically powered impact hammer of the type which has an axis and utilizes a hydraulically compressed gas charge to store energy, which energy is abruptly released axially to drive the hammer for the purpose of axially driving a tool, said hammer and the means to drive it being mounted to a frame, said frame having a nose with an external peripheral axially-extending bearing surface, the improvement comprising: a tool mount adapted to hold said tool, said mount having an internal axially-extending bearing surface, said bearing surfaces being in axial sliding embracing telescopic relationship with part of said mount extending around said nose, said mount being so disposed and arranged as to be struck by said hammer in order to drive said tool.

2. Apparatus according to claim 1 in which said mount is cup-shaped, and in which said tool is coaxially mounted to said mount.

3. Apparatus according to claim 2 in which means for mounting said tool to said mount comprises a tapered wall enlarging in the direction away from the hammer for the purpose of receiving a tool having a tapered external surface to fit therein.

4. Apparatus according to claim 2 in which said mount is provided with releasable retention means to retain said mount to said frame.

5. Apparatus according to claim 2 in which a seal is formed between said amount and said frame whereby when said mount is driven, a reduced pressure is developed between them to hold the mount against being driven off the frame.

* * * * *